US008910784B2

(12) United States Patent
Moore et al.

(10) Patent No.: US 8,910,784 B2
(45) Date of Patent: Dec. 16, 2014

(54) PACKET SLEEVE INCLUDING POCKET

(75) Inventors: Pamela D. Moore, Gloucester, VA (US); Stephen J. Bellamah, Midlothian, VA (US); Dominic J. C. Howard, New Canaan, CT (US)

(73) Assignee: Philip Morris USA Inc., Richmond, VA (US)

( * ) Notice: Subject to any disclaimer, the term of this patent is extended or adjusted under 35 U.S.C. 154(b) by 1036 days.

(21) Appl. No.: 12/848,658

(22) Filed: Aug. 2, 2010

(65) Prior Publication Data

US 2011/0155796 A1 Jun. 30, 2011

Related U.S. Application Data

(63) Continuation of application No. 12/634,309, filed on Dec. 9, 2009, now abandoned.

(60) Provisional application No. 61/121,423, filed on Dec. 10, 2008.

(51) Int. Cl.

| | |
|---|---|
| ***A24F 15/00*** | (2006.01) |
| ***B65D 85/10*** | (2006.01) |
| ***B65D 85/12*** | (2006.01) |
| ***B65D 5/42*** | (2006.01) |
| ***B65D 5/38*** | (2006.01) |

(52) U.S. Cl.

CPC ..... *B65D 85/1081* (2013.01); *B65D 5/4204* (2013.01); *B65D 5/38* (2013.01)

USPC ..... 206/273

(58) Field of Classification Search

USPC ..... 229/125.125, 87.13, 160.1; 206/45.21, 206/273, 92, 93, 733, 734, 45.25, 751, 1.5, 206/242–267, 268

See application file for complete search history.

(56) References Cited

U.S. PATENT DOCUMENTS

| | | | | |
|---|---|---|---|---|
| D71,036 | S | 9/1926 | Turpisch | |
| 1,844,189 | A * | 2/1932 | Stuart | 206/734 |
| 1,906,742 | A | 5/1933 | Coulapides | |
| 2,011,399 | A | 8/1935 | Driscoll | |
| 2,012,557 | A * | 8/1935 | Willens et al. | 206/93 |
| D123,625 | S | 11/1940 | Meyer | |
| D134,173 | S | 10/1942 | Kanter | |

(Continued)

FOREIGN PATENT DOCUMENTS

| | | |
|---|---|---|
| DE | 297 08 543 U1 | 7/1997 |
| DE | 299 01 874 U1 | 4/1999 |

OTHER PUBLICATIONS

Aug. 5, 2009 International Search Report and Written Opinion issued in PCT/IB2008/003679.

*Primary Examiner* — Mickey Yu
*Assistant Examiner* — Chun Cheung
(74) *Attorney, Agent, or Firm* — Buchanan Ingersoll & Rooney PC

(57) ABSTRACT

A combined article package includes a sleeve having a pocket formed integrally therein with a cigarette package in the sleeve and an insert in the pocket. The sleeve can be formed from a single piece blank. The insert can be a coupon or a separate consumer product, such as smoking articles, smokeless tobacco, and the like. For instance, the insert can be a foil pack containing one or more promotional smokeless tobacco products. The combined article package can be sized to be compatible with cigarette cartons, cigarette display racks, tax-stamping equipment and the like.

18 Claims, 8 Drawing Sheets

(56) References Cited

U.S. PATENT DOCUMENTS

| | | | | | |
|---|---|---|---|---|---|
| 2,351,223 | A | * | 6/1944 | Neivert | 206/93 |
| 2,494,724 | A | | 1/1950 | Schmidt | |
| D168,131 | S | | 11/1952 | Touart, Jr. | |
| D169,066 | S | | 3/1953 | Halpern | |
| 3,039,671 | A | | 6/1962 | Chiamardas | |
| 3,241,738 | A | | 3/1966 | Freiman | |
| 3,563,449 | A | | 2/1971 | Forbes, Jr. et al. | |
| 3,901,386 | A | | 8/1975 | Hennessey | |
| 4,003,467 | A | | 1/1977 | Focket et al. | |
| D261,110 | S | | 10/1981 | Yoshimoto | |
| D266,224 | S | | 9/1982 | Bronander, Jr. | |
| D273,426 | S | | 4/1984 | Zucker | |
| D277,034 | S | | 1/1985 | Ramsdell | |
| D296,718 | S | | 7/1988 | Takanashi | |
| D309,570 | S | | 7/1990 | Kinoshita | |
| D319,587 | S | | 9/1991 | Lee | |
| D344,018 | S | | 2/1994 | Kelsey et al. | |
| 5,301,805 | A | * | 4/1994 | Evers et al. | 206/273 |
| 5,366,077 | A | | 11/1994 | Pham | |
| D353,091 | S | | 12/1994 | Mumford | |
| 5,388,594 | A | | 2/1995 | Counts et al. | |
| 5,505,214 | A | | 4/1996 | Collins et al. | |
| D370,301 | S | | 5/1996 | Murphy | |
| 5,513,752 | A | | 5/1996 | Gottlieb | |
| D395,235 | S | | 6/1998 | Andersson | |
| D401,853 | S | | 12/1998 | Stavridis | |
| D423,931 | S | | 5/2000 | Davis | |
| 6,467,614 | B1 | | 10/2002 | Tallier et al. | |
| D465,416 | S | | 11/2002 | Dzwill et al. | |
| 6,510,943 | B2 | | 1/2003 | Okin et al. | |
| D470,411 | S | | 2/2003 | Menceles | |
| D496,135 | S | | 9/2004 | Hillock | |
| 6,837,369 | B2 | | 1/2005 | Amos | |
| 6,932,219 | B2 | | 8/2005 | Chacko et al. | |
| D537,561 | S | | 2/2007 | Counts et al. | |
| 7,234,593 | B2 | | 6/2007 | Fath et al. | |
| 7,331,451 | B2 | | 2/2008 | Focke et al. | |
| D575,452 | S | | 8/2008 | Jones et al. | |
| D580,751 | S | | 11/2008 | Blick | |
| D596,349 | S | | 7/2009 | Tabrah | |
| D596,788 | S | | 7/2009 | Fuente | |
| 8,006,835 | B2 | | 8/2011 | Moore et al. | |
| 2002/0117409 | A1 | | 8/2002 | Okin et al. | |
| 2003/0034255 | A1 | | 2/2003 | Luton et al. | |
| 2003/0121805 | A1 | | 7/2003 | Chacko et al. | |
| 2004/0222110 | A1 | | 11/2004 | Holmon | |
| 2005/0000841 | A1 | | 1/2005 | DuBois et al. | |
| 2006/0054518 | A1 | | 3/2006 | Focke et al. | |
| 2008/0093233 | A1 | | 4/2008 | Jones et al. | |
| 2008/0164161 | A1 | | 7/2008 | Tosaka et al. | |

* cited by examiner

PACKET SLEEVE INCLUDING POCKET

CROSS REFERENCE TO RELATED APPLICATION

This application is a continuation application of U.S. application Ser. No. 12/634,309 entitled PACKET SLEEVE INCLUDING POCKET, filed on Dec. 9, 2009 now abandoned which claims priority under 35 U.S.C. §119(e) to U.S. provisional Application No. 61/121,423, filed on Dec. 10, 2008, the entire content of which is incorporated herein by reference.

SUMMARY

Provided in an embodiment is a blank of foldable material for forming a sleeve, comprising: back, right side, front, left side and pocket panels for forming respective back, right side, front, left side and pocket walls of the sleeve, wherein each panel comprises two substantially parallel long edges and two substantially parallel ends which are substantially perpendicular to the sides, the pocket panel connected to the back panel by a first fold line, the back panel connected to the right side panel by a second fold line, the right side panel connected to the front panel by a third fold line and the front panel connected to the left side panel by a fourth fold line, wherein the first fold line is along adjacent ends and the second, third and fourth fold lines are along adjacent sides; a pocket flap connected by a fifth fold line to an end of the pocket panel opposite to the first fold line; a side tab connected to a side of the back panel at a sixth fold line to join the left side panel to the back panel; wherein the blank is foldable to form a sleeve having a pocket integrally formed between the pocket panel and the back panel closable by the pocket flap and the sleeve surrounding a recess between the right side, front, left side and pocket panels, the recess open at the top and bottom of the sleeve.

An embodiment of a method of forming the sleeve from the blank, comprises folding the pocket, back, right side, front and left side panels and side tab of the blank along the first, second, third, fourth and sixth fold lines, overlying a portion of the back panel with a portion of the pocket panel to create a pocket having a pocket flap to close a top opening and overlying the side tab with a portion of the left side panel to create a sleeve having a recess open at the top and bottom and the pocket formed integrally therewith.

DETAILED DESCRIPTION

According to an embodiment, a cigarette package ("pack" or "packet") is within a sleeve open at the top and bottom and having a pocket formed therein to hold an insert or article package forming a combined article package. The insert may be a coupon, advertisement, game piece or the like and/or a foil pack to hold a separate consumer product. Preferably, the sleeve fits snugly around the cigarette package such that the insert can be removed from the pocket by a consumer without removing the sleeve from the cigarette package. Preferably, the cigarette package is the size of a king size, 100's size, 120's size, slender, very slender, or regular size package of cigarettes, or the like, and may comprise a hinge-lid box or a "soft" pack. Preferably, the insert is accommodated in the pocket of the sleeve on the cigarette package such that the combined article package fits within cigarette cartons and cigarette display racks. Furthermore, such a size of the combined article package can be tax-stamped with tax-stamping equipment. For instance, tax-stamping equipment removes the bottom of a cigarette carton, applies a tax stamp to each cigarette pack contained therein and reattaches the carton bottom.

Figure 1A:
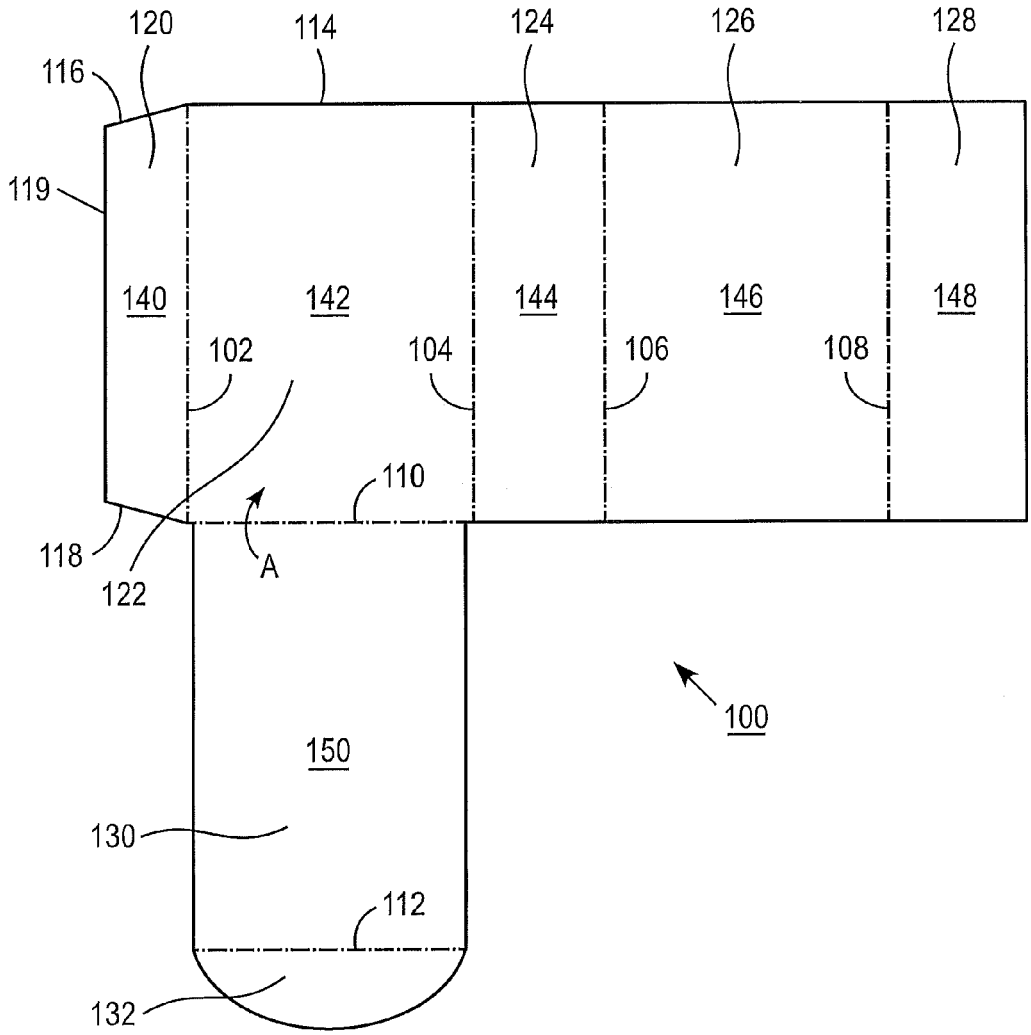
FIG. 1A is a plan view of an embodiment of a blank for forming a sleeve.
Figure 1B:
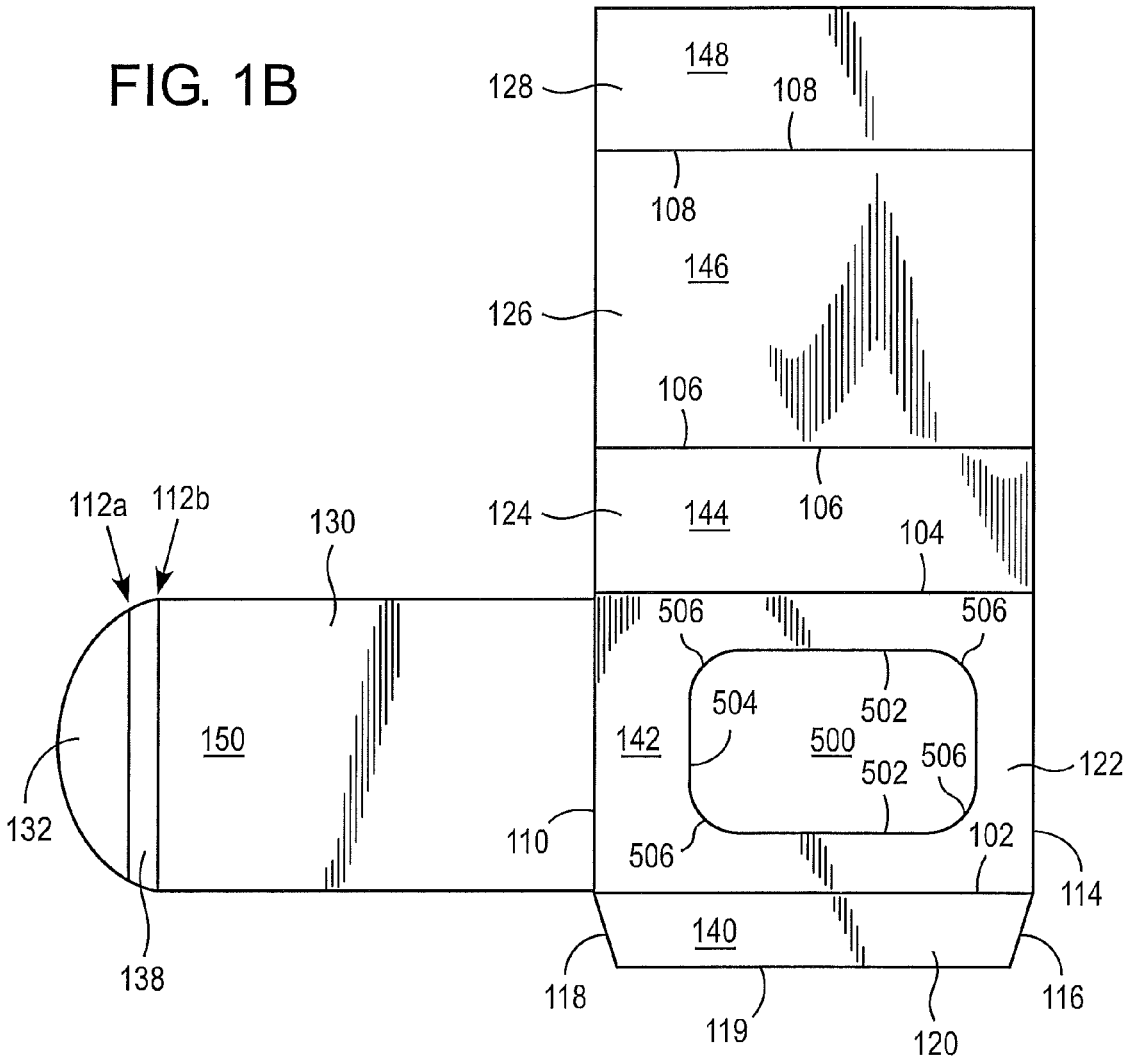
FIG. 1B is a plan view of another embodiment of a blank for forming a sleeve.

FIGS. 1A and 1B illustrate blanks 100 for forming a sleeve adapted to be placed over a cigarette package and hold an insert such as promotional products such as packaged tobacco pouched products, adjacent to the cigarette package in a pocket formed integrally with the sleeve. The cigarette package can be, for example, a soft pack or hinged-lid hard pack containing smoking articles, e.g., traditional cigarettes or non-traditional cigarettes such as described in commonly-owned U.S. Pat. Nos. 5,388,594 and 5,505,214, the entire contents of which are hereby incorporated by reference.

The embodiment of the blank shown in FIG. 1A has a one-piece configuration and comprises a plurality of panels, a side tab and a pocket flap. The panels are folded and one panel overlies another to form the pocket while still another panel overlies the side tab to form the sleeve having the pocket in a wall thereof. The pocket flap hinges at a fold line to open and close the formed pocket. The blank 100 includes a pocket panel 130, attached to a back panel 122 at a first fold line 110, a front panel 126 and two side panels 124 and 128 (right and left, respectively). Each of the panels has a substantially rectangular shape of opposed long sides and opposed short sides perpendicular to the long sides. Preferably, the front and back panels 126 and 122 are substantially the same size and shape to form a front and back, respectively, of the sleeve. Also preferably, the side panels 124/128 are of substantially matching size and shape to form right and left sides of the formed sleeve, respectively.

In the embodiment shown in FIG. 1B, the back panel 122 has a cut-out 500 formed therein. Preferably the cut-out 500 is defined by a substantially rectangular shape of opposed long edges 502 and opposed short edges 504 perpendicular to the long edges. Preferably the long edges 502 join the short edges 504 at rounded corners 506. The cut-out 500 provides a window to allow viewing through the back panel 122.

A right side of the back panel 122 is connected to an adjacent side of the right side panel 124 at a second fold line 104. The other side of the right side panel 124 is connected to an adjacent side of the front panel 126 at a third fold line 106. The other side of the front panel 126 is connected to an adjacent side of the left side panel 128 at a fourth fold line 108. A pocket flap 132 is also connected to the pocket panel 130 by a fifth fold line 112 at an opposite end of the pocket panel 130 from the back panel 122. The other side of the back panel 122 is connected to a side tab 140 at a sixth fold line 102.

Figures 2A, 2B, 2C:
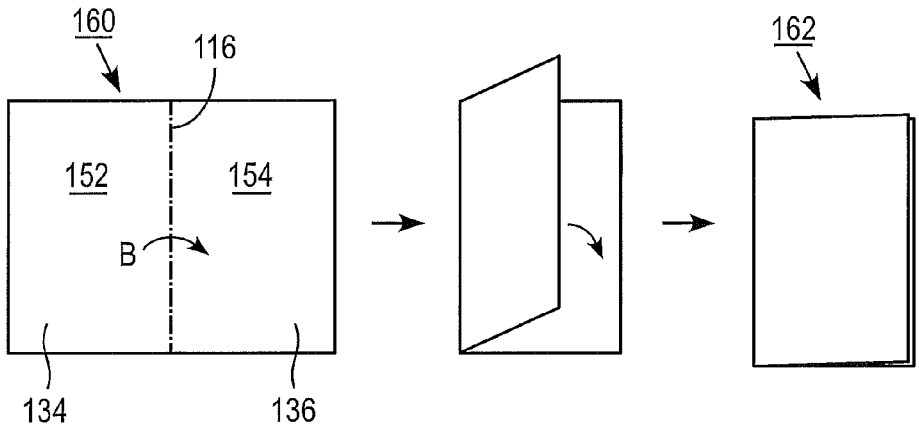
FIG. 2A shows an embodiment of an insert.
FIG. 2B shows the insert of FIG. 2A partially folded and FIG. 2C shows the insert of FIG. 2A folded.
Figure 7:
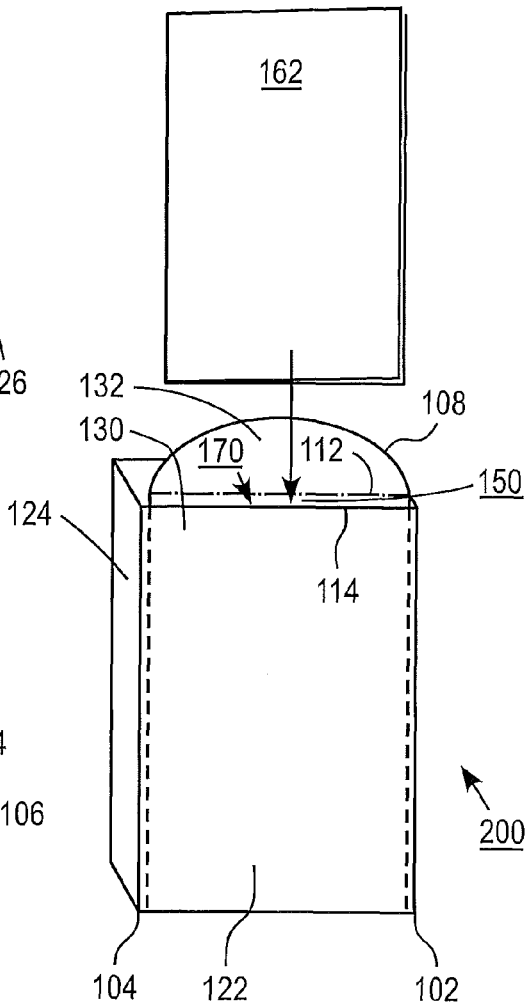
FIG. 7 is a back view of the sleeve formed of the blank of FIG. 1A with the folded insert of FIG. 2C.
Figure 8:
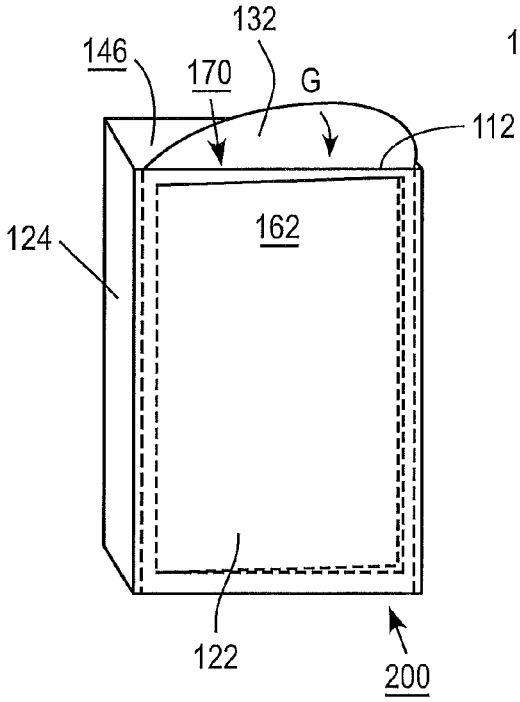
FIG. 8 shows the insert of FIG. 2C located in the pocket of the sleeve of FIG. 6.

FIG. 2A shows an embodiment of an insert 160. The insert may have appropriate markings such as to provide a coupon, game piece, advertisement, collectible memorabilia, or the like. First panel 134 of the insert 160 may be folded along seventh fold line 116 as indicated by arrow "B" toward second panel 136 as shown in FIG. 2B such that a first surface 152 is adjacent a second surface 154 (FIG. 2C) to form a folded insert 162. The insert 162 can be folded multiple times and in various orientations to form a folded insert 162 or the insert 160 may be used in an unfolded position as desired. The insert 160/162 is located in a pocket formed in the sleeve as shown in FIGS. 7 and 8 and as described below.

Figure 3A:
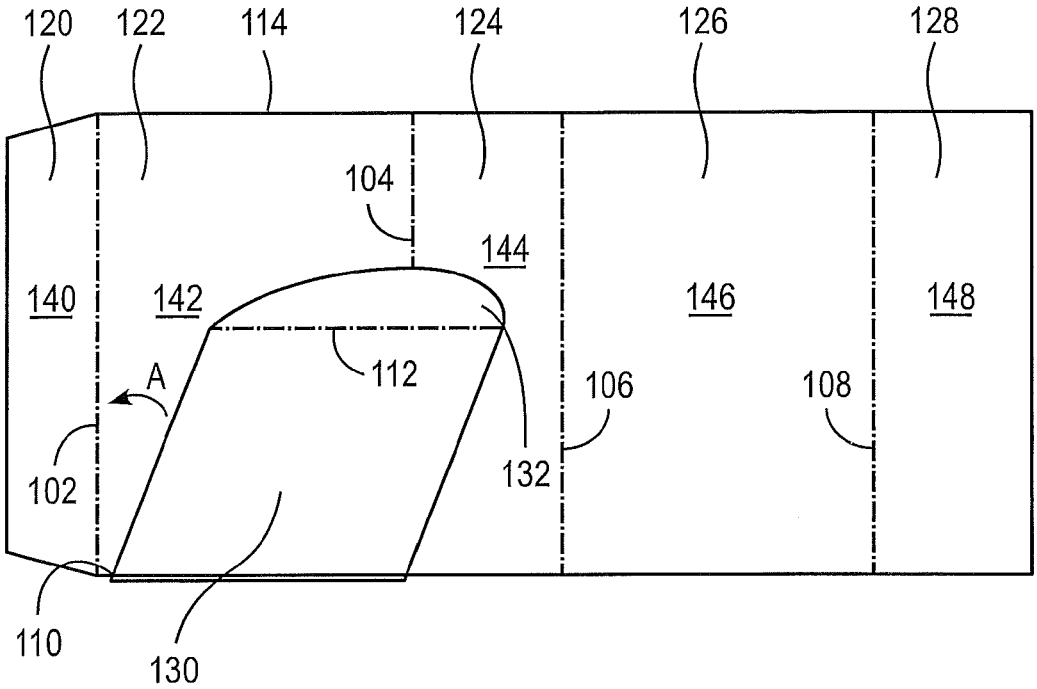
FIG. 3A illustrates folding a pocket panel of the blank shown in FIG. 1A.
Figure 3B:
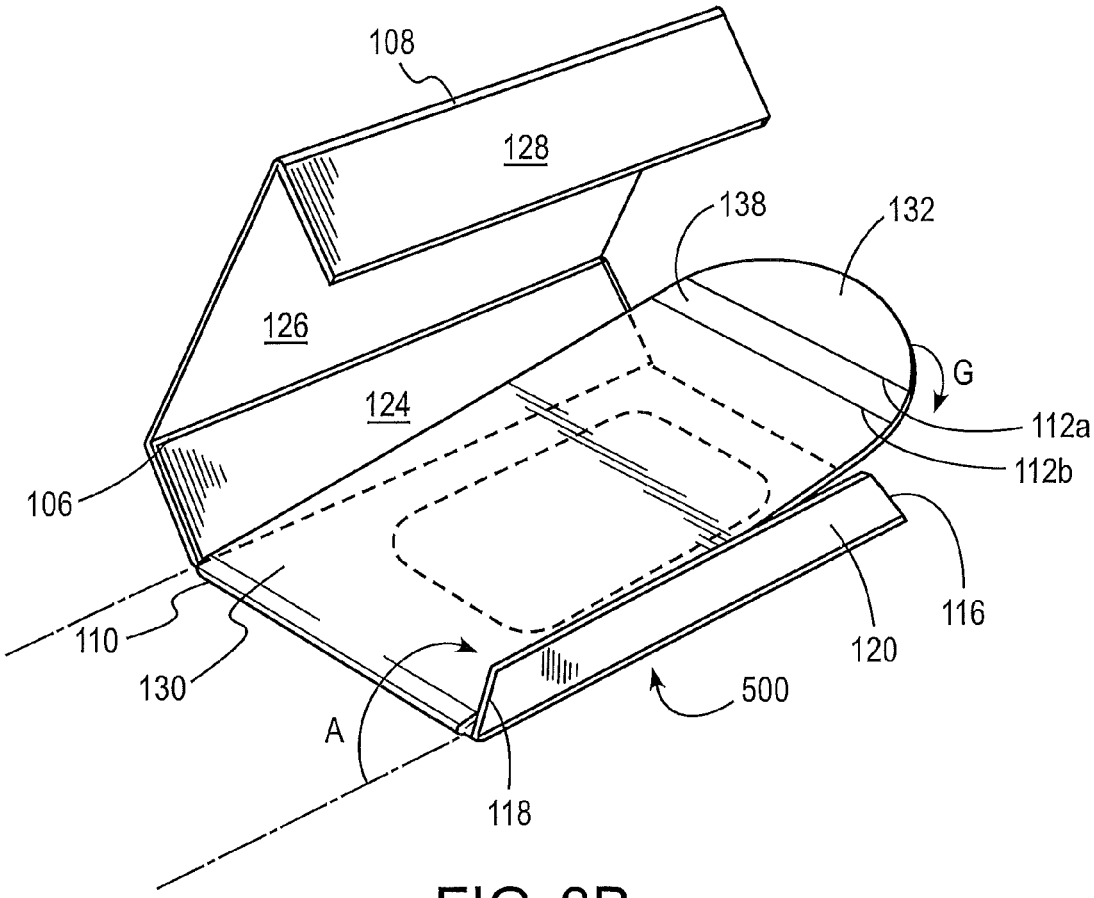
FIG. 3B illustrates folding a pocket panel of the blank shown in FIG. 1B.

When the pocket panel 130 is folded at the fold line 110 as indicated by arrow "A" in FIG. 3A, an inside surface 150 (FIG. 1A) of the pocket panel 130 faces an inside surface 142 of the back panel 122 and a pocket 170 (FIG. 7) is formed between the surfaces 150 and 142. The back panel 122 forms a pocket wall and the pocket panel 130 forms an overlying pocket wall. FIG. 3B shows the pocket panel 130 folded along fold line 110 for the embodiment having a cut-out 500 in the back panel 122. Preferably, the cut-out 500 provides a window for viewing contents of the pocket formed between the surfaces 150 and 142. The pocket flap 132 extends beyond a top edge 114 of the back panel 122 and preferably the pocket flap 132 is rounded. Preferably the size of the pocket panel 130 substantially matches the size of the back panel 122 (FIG. 4), however the pocket panel may be narrower than the back panel 122 such that the pocket panel 130 will not interfere with other folding of panels to form the sleeve.

Preferably, the pocket panel 130 is centered on the back panel 122. The fifth fold line 112 is preferably slightly above the top edge 114 of the back panel 122 to facilitate closing of the pocket 170 (FIG. 7) when the pocket panel 130 overlies the back panel 122. Preferably, the sides of the pocket panel 130 are not bonded to the back panel 122 such that the pocket 170 is formed by the first and fifth fold lines 110/112 holding the pocket panel 130 to the back panel 122. In the embodiment shown in FIG. 3B, the fifth fold line 112 is separated into two fold lines 112*a* and 112*b* spaced apart at the top of the pocket panel 130 forming a top flap 138.

Figure 4:
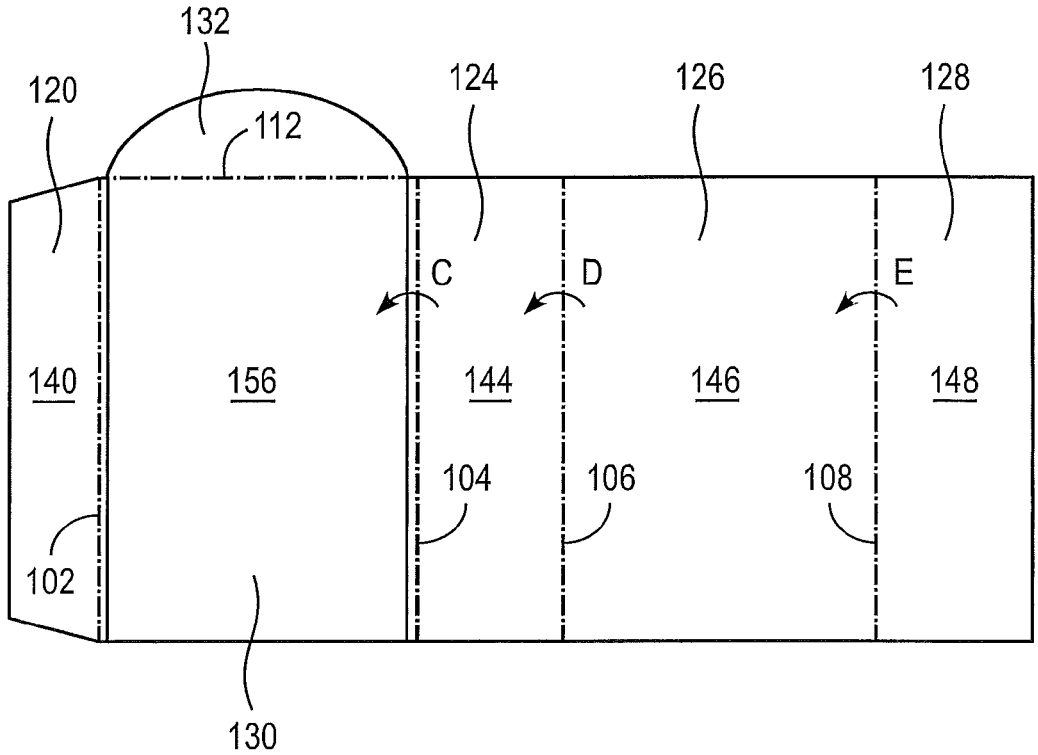
FIG. 4 shows the pocket panel of FIG. 3A folded to form a pocket.
Figure 5B:
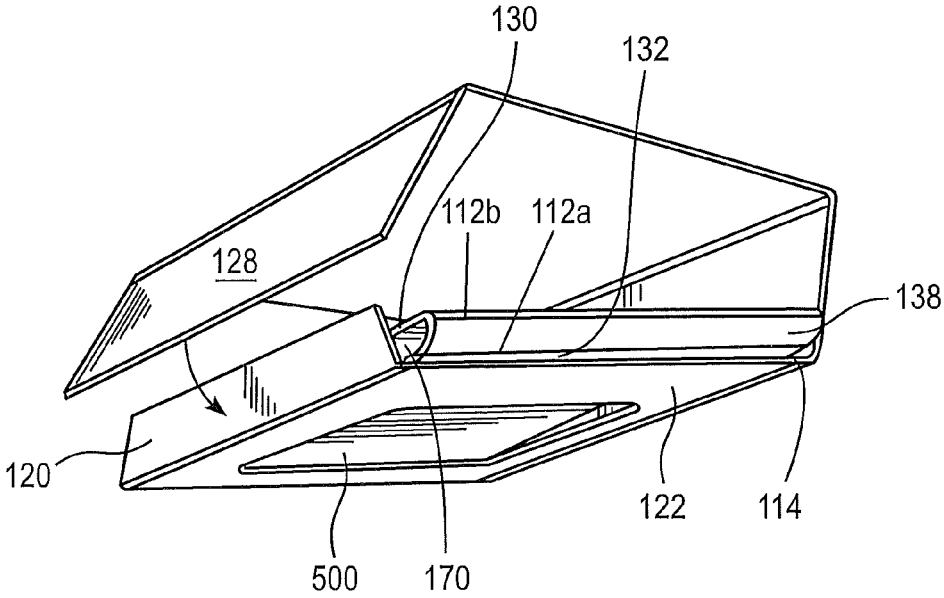
FIG. 5B shows the blank of FIG. 1B partially folded.
Figure 5A:
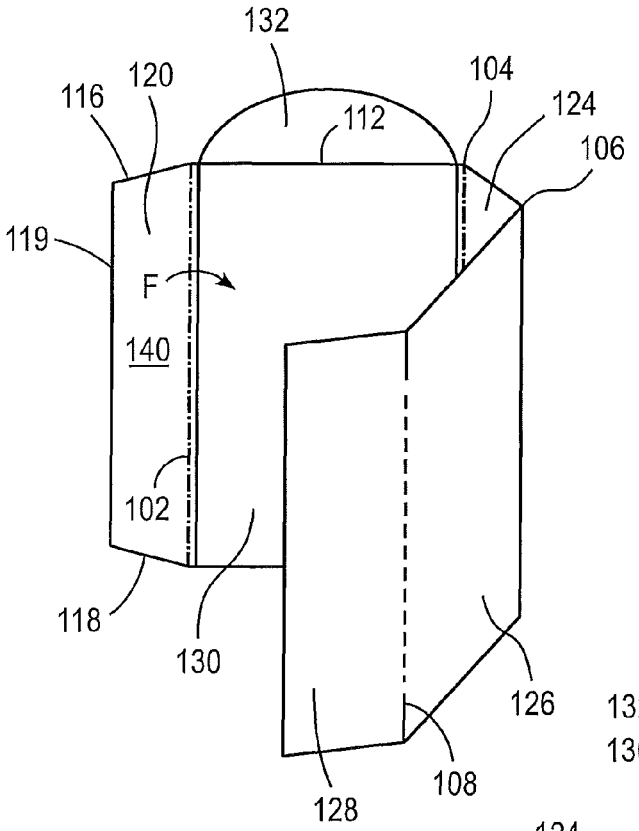
FIG. 5A shows the blank of FIG. 1A partially folded.

When the blank 100 is folded at the fold lines 102, 104, 106 and 108, such as shown by arrows "C", "D" and "E" in FIG. 4 and arrow "F" in FIG. 5A, a portion of the left panel 128 overlies the side tab 120. Preferably, the side tab 120 is trapezoidal and has the fold line 102 as one of the sides thereof. Non-parallel ends 116 and 118 of the side tab 120 extend to the other, shorter, side 119 of the side tab 120. Preferably, the non-parallel ends 116 and 118 extend at the same angle from the fold line 102, however the non-parallel ends 116 and 118 may extend at different angles to the other parallel side 119 of the side tab 120. Preferably, an adhesive is applied to a surface of the side tab 120 to bond the left side panel 128 adjacent to the back panel 122 at about the sixth fold line 102 to form a sleeve 200.

In a preferred embodiment (FIG. 5B), the pocket flap 132 folds at the fifth fold lines 112*a* and 112*b* and tucks inside the pocket 170 so that the top flap 138 closes the pocket 170. The top flap 138 offsets the pocket panel 130 from the back panel 122 by about the distance between the fifth fold lines 112*a* and 112*b*. If desired, the pocket flap 132 can be bonded to the inside of the back panel 122. However, easily breaking such a bond by a consumer is preferred, for example, by separating the pocket flap 132 and the back panel 122 such as by inserting a fingertip between the fold line 112*a* and the top edge 114 of the back panel 122 is preferred.

Figure 6:
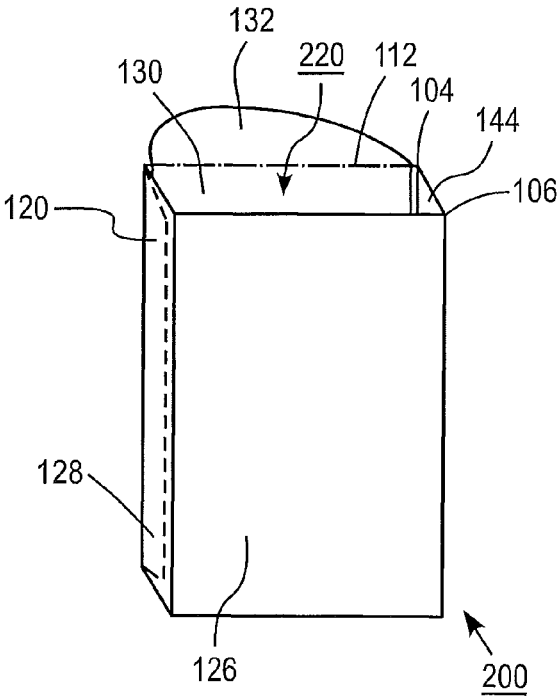
FIG. 6 shows a front view of the sleeve formed by folding the blank of FIG. 1A.

FIG. 6 shows the side tab 120 (dashed line) lying beneath the left side panel 128 of the erected sleeve 200. The inside surface 144 of the right side panel 124, the inside surface 146 of the front panel 126, a portion of the inside surface 148 of the left side panel 128 not overlying the side tab 120, the inside surface 140 of the side tab 120 and the inside surface 156 of the pocket panel 130 define a recess 220 within the sleeve 200 open at the top and bottom of the sleeve 200. FIG. 6 also shows the pocket flap 132 partially folded away from the recess 220 along fold line 112 partially closing pocket 170.

FIG. 7 is a back view of sleeve 200 showing the pocket panel 130 (dashed line) folded behind the back panel 122 to form the pocket 170. The pocket flap 132 is in an open position to accept the insert 162 into the pocket 170. Preferably, the pocket flap 132 hinges at the fifth fold line 112 which is above the top edge 114 of the back panel 122 to allow bulging of the pocket panel 130 away from the back panel 122 when the pocket 170 accommodates an insert 162 while still providing a crisp and uniform look and feel to the sleeve 200 when the pocket flap 132 is closed.

Figure 9:
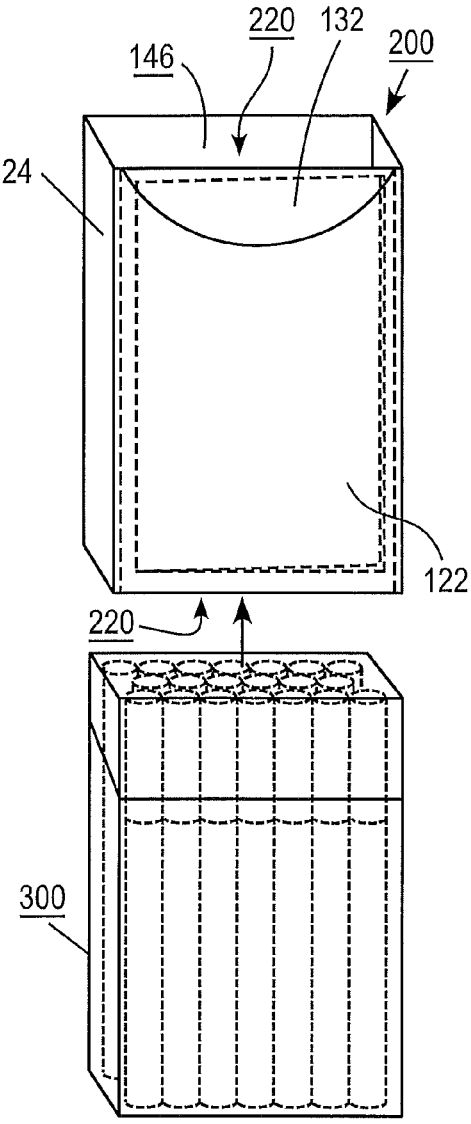
FIG. 9 shows the sleeve and insert of FIG. 8 with a pocket flap closed over the pocket and a cigarette package positioned for inserting in the sleeve.

FIG. 8 shows the insert 162 in shadow lines within the pocket 170 of the sleeve 200. The pocket flap 132 closes the pocket 170 when hinged about fold line 112 as shown by arrow "G". In such a preferred embodiment the pocket flap 132 is bonded to the outside of the back panel 122 with an adhesive or the like (for example, glue, tape, VELCRO, etc.). Such an adhesive is preferably of limited strength so as to be openable by a user. FIG. 9 shows a cigarette package 300 positioned to fit within the recess 220 of the sleeve 200 and the sleeve 200 positioned to surround the cigarette package 300. The cigarette package 300 fits snugly within the recess 220 of the sleeve 200. The pocket flap 132 is shown in the closed position.

Figure 10:
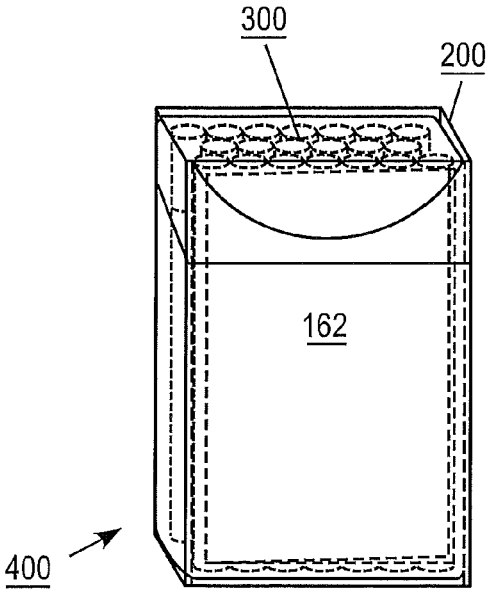
FIG. 10 is a partially transparent back view of the cigarette package and insert located in the sleeve of FIG. 6.

FIG. 10 shows the cigarette package 300 fit snugly within the recess 220 of the sleeve 200 with an insert 162 located in the pocket 170 of the sleeve 200 to form a combined article package 400. Preferably, the cigarette package 300 is held in place by friction within the sleeve 200. Also preferably, the cigarette package 300 applies a lateral force to press the pocket panel 130 toward the back panel 122.

The blank 100 can be composed of any suitable material, e.g., plastic, metal, foil, paper board and combinations thereof. Preferably, the blank 100 is composed of a paper suitable for forming hinged-lid cigarette boxes. The blank 100 can include one or more layers of the paper material.

In a preferred embodiment, the front panel 126 and the back panel 122 are about 75-130 mm×50-65 mm (e.g., about 82-87 mm×about 50-58 mm, about 95-105 mm×about 50-58 mm, 110-120 mm×about 50-58 mm or about 120-130 mm×50-58 mm), the side panels 124 and 128 are about 75-130 mm×17-30 mm (e.g., the same height as the front and back panels 126 and 122 and about 20-27 mm wide). The right panel 124 is preferably narrower than the left side panel 128 by about the thickness of the blank material (e.g., about 0.1-1.0 mm, about 0.2-0.4 mm or 4-14 point (PT), e.g., 8-12 PT board), such that when the left panel 128 overlies the side tab 140, the formed sleeve 200 has a substantially rectangular cross section. Paperboard (board) is generally referred to by weight (grams per square meter, pounds per 1000 square feet) or by thickness (mm or thousandths of an inch, or points (PT), e.g., 0.009" thick paperboard is also known as 9 point) or by name: foodboard, chipboard, solid bleached sulphate, clay coated, corrugating medium, boxboard, etc. Preferably, the blank 100 is composed of a stock paper material of 14 PT or less in thickness.

In a preferred embodiment, the side tab 120 extends about 10-20 mm (e.g., about 14-18 mm) from the sixth fold line 102 to the short parallel side 119 which is about 2-15 mm (e.g., about 5-10 mm) shorter than the other side of the side tab 120 (fold line 102) such that the non-parallel ends 116 and 118 of the side tab 120 join the short parallel side 119 at equal obtuse angles. Preferably, the pocket panel 130 is about 1-5 mm narrower (e.g., about 2-4 mm narrower) than the back panel 142. Preferably, the pocket panel 130 is about 1-5 mm longer (e.g., about 2-4 mm longer) than the back panel 142, such that fifth fold line 112 extends about 1-5 mm (e.g., about 2-4 mm) above the top edge 114 of the back panel 122 when the pocket panel 130 forms a pocket 170 with the back panel 122. Preferably the pocket flap 132 extends about 10-20 mm (e.g., about 14-18 mm) from the fifth fold line 112.

Figure 11A:
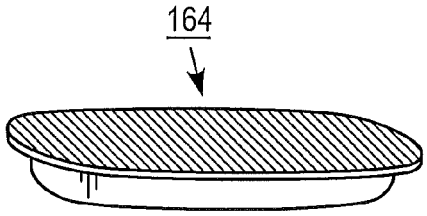
FIGS. 11A and 11B are another embodiment of an insert.
Figure 11B:
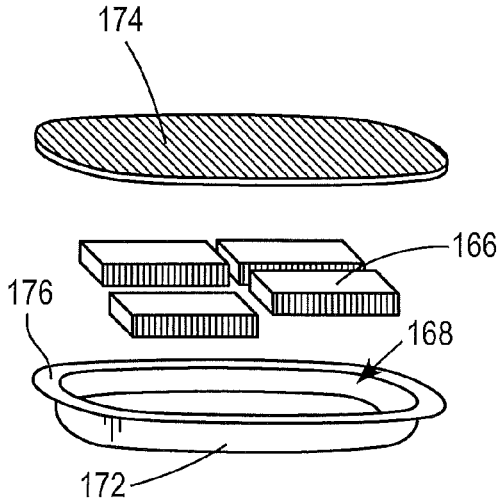

FIG. 11A shows another embodiment of an insert. As mentioned, the insert can be an article package 164, such as a foil pack or the like. FIG. 11A shows a tray shaped article package 164. The article package 164 includes a removable cover 174 and a base 172 as shown in FIG. 11B. FIG. 11B also shows the base 172 of the article package 164 having a flange 176 around the periphery of an opening to an interior space 168 of the article package 164. The cover 174 is bonded to the flange 176 to enclose the interior space 168. Preferably, the cover 174 is hermetically sealed to the flange 176. Preferably, the cover 174 has a thumb tab for a user to grip the cover 174 during removal of the cover 174 from the base 172 to access the interior space 168.

In a preferred embodiment, the article package 164 is a foil pack having a bottom of a base 172 about 55-65 mm×11-16 mm (e.g., about 57-63 mm×12-14 mm) with rounded corners having radii about 0.5-2 mm (e.g., about 1 mm) connected to sidewalls extending about 11-16 mm (e.g., about 12-14 mm) above the base 172, where opposed long sidewalls are spaced apart by about 13-19 mm (e.g., about 15-17 mm) and opposed short sidewalls are spaced apart by about 55-65 mm (e.g. about 57-63 mm). Preferably, the flange 176 around the periphery of the opening formed by the sidewalls of the article package 164 is about 1-5 mm (e.g., about 2-4 mm) wide. Preferably, the cover 174 is about 60-70 mm×18-26 mm (e.g. about 64-68 mm×20-24 mm) and has squared corner radii of about 1-3 mm (e.g., about 2 mm).

FIG. 11B shows an embodiment of the article package 164 including consumer products 166 contained in the interior space 168. In a preferred embodiment, the consumer products 166 include smokeless tobacco products such as pouched smokeless tobacco (SNUS).

Figure 12:
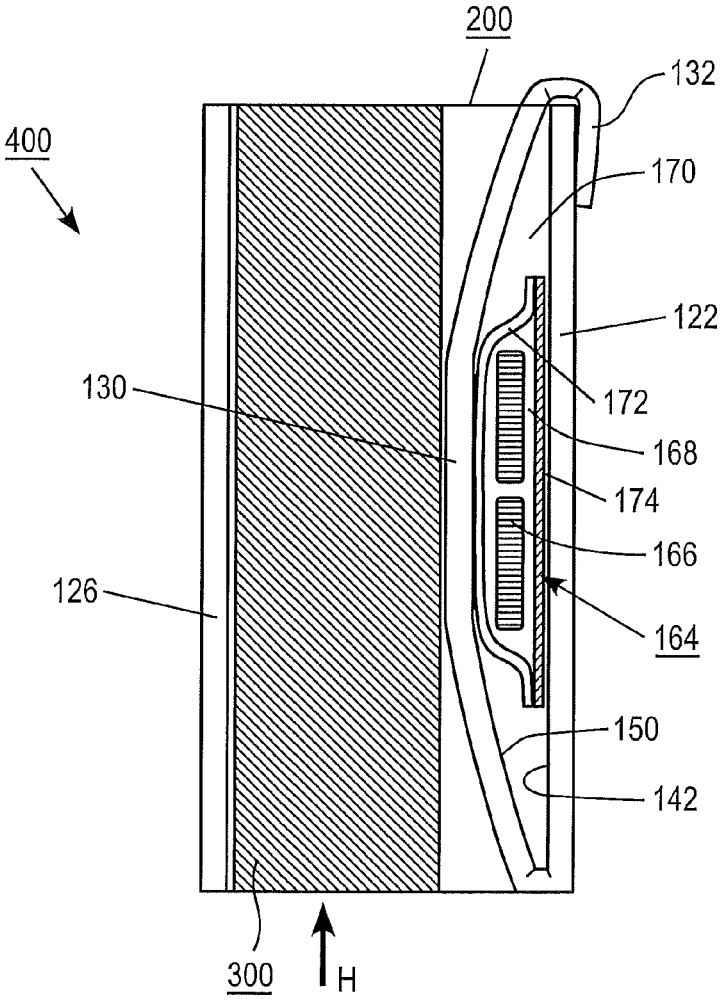
FIG. 12 is a cross section view through another embodiment of a sleeve formed from a blank of FIG. 1A containing a cigarette package and the insert of FIGS. 11A and 11B.

FIG. 12 shows a cross section through an embodiment of a combined article package 400 containing the article package 164 of FIGS. 11A and 11B. Preferably, the combined article package 400 is of a size and shape to be used in cigarette cartons, cigarette displays and tax-stamping operations with tax-stamping machines (represented by arrow "H" in FIG. 12).

Figure 13:
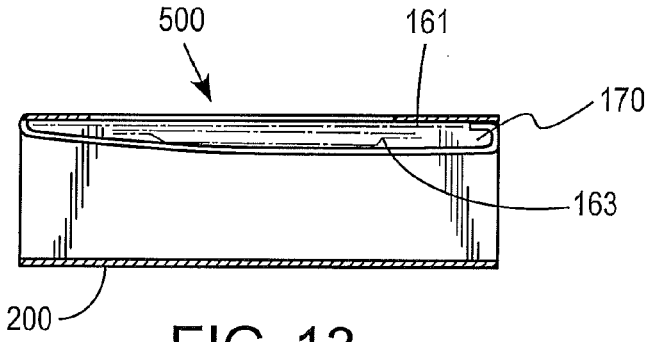
FIG. 13 shows a cross-sectional view of the sleeve formed by folding the blank of FIG. 1B.

FIG. 13 shows a cross section (along line IV shown in FIG. 14) through a preferred embodiment of a sleeve 200 including a cut-out 500 (window) for viewing a first insert 161 overlying a second insert 163 in a pocket 170. The first insert 161 can be a folded or non-folded insert 162 such as shown in FIGS. 2A and 2C. The second insert 163 can be an article package 164 such as a blister pack, foil pack or the like, as shown in FIGS. 11A and 11B.

Figure 14:
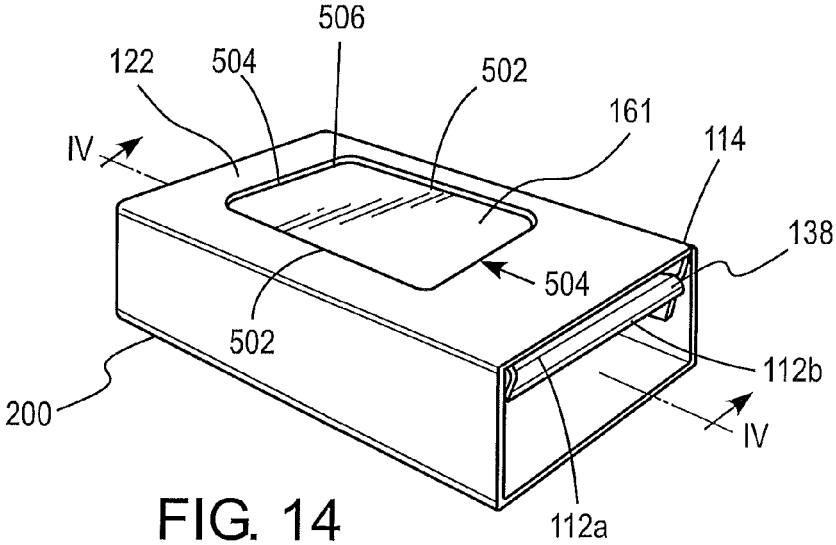
FIG. 14 is a three-dimensional perspective view of the sleeve of FIG. 13.

FIG. 14 shows a three-dimensional perspective view of the sleeve 200 of FIG. 13. Preferably, the first insert 161 can be viewed through the cut-out 500 in the back panel 122 of the sleeve. Preferably, the first insert 161 partially or completely covers the second insert 163 from view. Also, the pocket 170 can contain one or more inserts if desired, and a portion of one or a portion of all of the inserts can be viewable through the cut-out 500.

Figure 15:
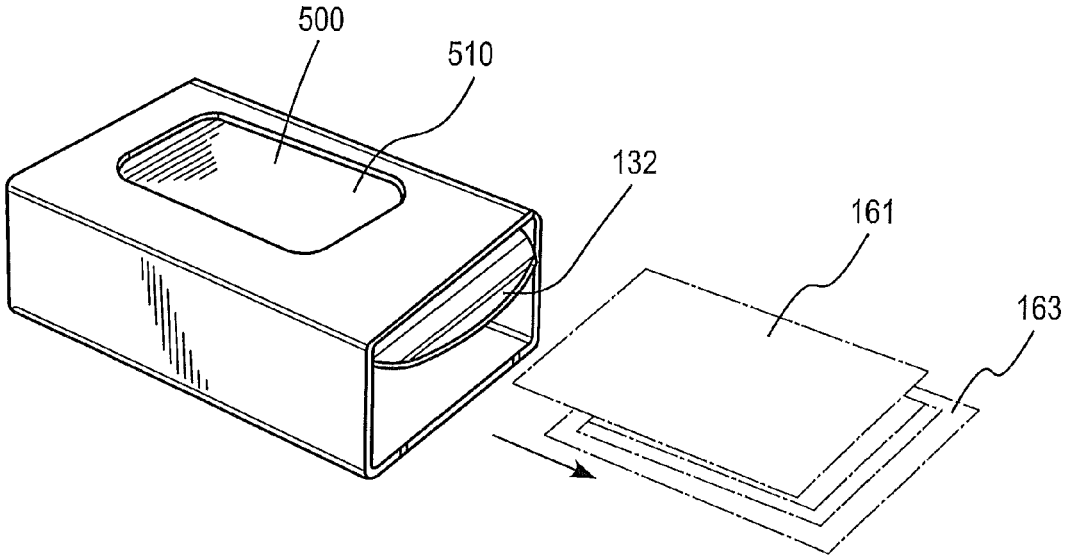
FIG. 15 shows embodiments of inserts and the sleeve of FIG. 14.

The top flap 138 of the sleeve 200 opens by hinging about fifth fold lines 112*a* and 112*b* (FIG. 15). First and second inserts 161/163 are slideably removable from the pocket 170. Optionally, a film 510 such as a transparent polymer or the like can cover the cut-out 500.

Preferably, when a plurality of combined article packages 400 are arranged for packaging in a carton each combined article package 400 is of a size and shape to allow a carton machine to form the carton around the combined article packages 400 from a carton blank (not shown). For example, commonly-assigned U.S. Pat. No. 7,234,593, the entire content of which is hereby incorporated by reference, describes loading cartons and applying tax stamps to individual packs before the carton is sealed.

The sleeve 200 can be used with various size cigarette packages 300 having a rectangular longitudinal cross-sectional shape and inserts 160/162/164 of various shapes. The cigarette packages can be soft packs or hard packs made from cardboard in which cigarettes are stored. Such containers can include a top portion hinged to a bottom portion. Such containers can have an outer cellophane wrapper to retain the freshness of the smoking articles. One of such packages can be inserted into the recess 220 of the formed sleeve 200, such that the sleeve 200 overlies the front face, side faces and rear face of the package. Alternatively, the blank 100 can be placed on the package and folded to form the sleeve 200. One or more loose objects, or objects in a second container, such as promotional products, can then be inserted in the pocket 170.

Now a method of folding the blank 100 to form an embodiment of a combined article package 400 will be described.

Preferably the pocket panel 130 is folded at the first fold line 110 to form the pocket 170. Preferably, the back, front and side panels 122/126/124/128 and the side tab 120 are folded at the second, third, fourth and sixth fold lines 104/106/108/102 to form a pre-folded pre-sleeve that can be mass handled at a high rate of speed in a packaging apparatus if desired. The insert 161/162/163/164 can be placed in the pocket 170 in various ways, for example, the insert 161/162/163/164 can be placed in the pocket 170 before the sleeve 200 is placed on the cigarette package 300, after the sleeve 200 is placed on the cigarette package 300 or the insert can be placed on the surface 142 of the back panel 122 and folded into the pocket 170. Preferably, to form the combined article package 400, steps such as bonding the side tab 120 to the left side panel 128 to form a sleeve 200 before placing the cigarette package 300 in the recess 220 of the sleeve 200 can be included. In another embodiment, steps can include wrapping the pre-folded pre-sleeve around the cigarette package 300 and bonding the side tab 120 to the left side panel 128.

In an embodiment, the front panel 126 forms an outer front face of the sleeve 200 and an inner front face 146 of the recess 220. The right side panel 124 forms a right outer side face of the sleeve 200 and an inner right side face 144 of the recess 220. The left side panel 128 forms a left outer side face of the sleeve 200, a portion of the inner left side face of the recess 220 and the side tab 120 forms the remaining portion 140 of the inner left side face of the recess 220. The back panel 122 forms an outer back face of the sleeve 200 and an inner back face 142 of the pocket 170. The pocket panel 130 forms an inner front face 150 of the pocket 170 and an inner back face 156 of the recess 220. The pocket flap 132 overlies a top portion of the outer back face to close the pocket 170. Optionally, the pocket flap 132 can be tucked in to underlie a top portion of the back panel 122 to close the pocket 170. Preferably, the pocket flap 132 is bonded to the back panel 122, for example, with glue, tape or the like.

In another embodiment, a cut-out 500 is cut in the back panel 122 to form a window before the pocket panel 130 is folded at the first fold line 110 and the back, front and side panels 122/126/124/128 and the side tab 120 are folded at the second, third, fourth and sixth fold lines 104/106/108/102. In other aspects the blank 100 with the cut-out 500 (window) in the back panel 122 is assembled into a sleeve 200 as described above. Preferably, the sleeve 200 is combined with inserts 161/162/163/164 in the pocket 170 as described above such that a portion of one or a portion of all of the inserts 161/162/163/164 can be viewed through the cut-out 500 (window). Thus, different inserts with different indicia on the inserts can be placed in the pocket and the various indicia can be viewed without changing printed material on the sleeve. The sleeve 200 is assembled on a cigarette pack 300 to form a combined article package 400 as described above.

While the invention has been described in detail with reference to specific embodiments thereof, it will be apparent to those skilled in the art that various changes and modifications can be made, and equivalents employed, without departing from the scope of the appended claims.

The invention claimed is:

1. A sleeve formed from a blank of foldable material, the blank comprising:

back, right side, front, left side and pocket panels for forming respective back, right side, front, left side and pocket walls of the sleeve, wherein each panel comprises two substantially parallel long edges and two substantially parallel ends which are substantially perpendicular to the sides, the pocket panel connected to the back panel by a first fold line, the back panel connected to the right side panel by a second fold line, the right side panel connected to the front panel by a third fold line and the front panel connected to the left side panel by a fourth fold line, wherein the first fold line is along adjacent ends and the second, third and fourth fold lines are along adjacent sides;

a pocket flap connected by a fifth fold line to an end of the pocket panel opposite to the first fold line;

a side tab connected to a side of the back panel at a sixth fold line to join the left side panel to the back panel;

wherein the blank is foldable to form the sleeve having a pocket integrally formed between the pocket panel and the back panel closable by the pocket flap and the sleeve surrounding a recess between the right side, front, left side and pocket panels, the recess open at the top and bottom of the sleeve, and wherein:

the front panel forms an outer front face of the sleeve and an inner front face of the recess;

the right side panel forms a right outer side face of the sleeve and an inner right side face of the recess;

the left side panel forms a left outer side face of the sleeve, a portion of an inner left side face of the recess and the side tab forms the remaining portion of the inner left side face of the recess;

the back panel forms an outer back face of the sleeve and an inner back face of the pocket;

the pocket panel forms an inner front face of the pocket and an inner back face of the recess; and the pocket flap overlies a top portion of the outer back face to close the pocket.

2. The sleeve of claim 1, wherein the pocket flap has a semi-circular periphery.

3. The sleeve of claim 1, wherein an adhesive material is provided on at least a portion of a face of the side tab.

4. The sleeve of claim 1, wherein a cut-out in the back panel forms a window into the pocket.

5. A combined article package comprising:

a cigarette package;

the sleeve according to claim 1 telescoped over and surrounding the cigarette package with a friction fit therebetween to hold the cigarette package in the recess; and an insert retained in the pocket of the sleeve.

6. The combined article package of claim 5, wherein a cut-out in the back panel forms a window and the insert retained in the pocket of the sleeve is viewable through the window.

7. The combined article package of claim 5, wherein the insert is a foil pack, coupon, game piece, collectable memorabilia, article package which has a removable cover enclosing a base, or a combination thereof.

8. The combined article package of claim 7, wherein the insert contains smokeless tobacco articles.

9. The combined article package of claim 7, wherein the base comprises:

an upper flange, a curved sidewall and a curved end wall and the cover comprises a membrane sealed to the flange.

10. The combined article package of claim 9, wherein the base is thermoformed and the cover is hermetically sealed to the flange, the membrane comprising a plastic film, foil or a composite thereof.

11. The combined article package of claim 9, wherein the base contains smokeless tobacco.

12. A method of forming the sleeve according to claim 1, comprising:

folding the pocket, back, right side, front and left side panels and side tab of the blank along the first, second, third, fourth and sixth fold lines, overlying a portion of the back panel with a portion of the pocket panel to create the pocket having the pocket flap to close the top opening and overlying the side tab with a portion of the left side panel to create the sleeve having the recess open at the top and bottom and the pocket formed integrally therewith.

13. The method of claim 12, further comprising filling the recess with a cigarette package, placing an insert in the pocket and adhesively bonding the pocket flap to an upper portion of the back panel on the outside of the sleeve to close the pocket, forming a combined article package.

14. The method of claim 13, further comprising adhesively bonding the side tab to the overlying portion of the left side panel.

15. The method of claim 13, further comprising filling a carton with a plurality of combined article packages.

16. A method of forming the sleeve according to claim 4, comprising:

folding the pocket, back, right side, front and left side panels and side tab of the blank along the first, second, third, fourth and sixth fold lines, overlying a portion of the back panel with a portion of the pocket panel to create the pocket having the pocket flap to close the top opening and adhesively bonding the side tab to a portion of the left side panel to create the sleeve having the recess open at the top and bottom and the pocket formed integrally therewith.

17. The method of claim 16, further comprising filling the recess with a cigarette package, placing an insert in the pocket viewable through the window and (i) tucking the pocket flap between an upper portion of the back panel and the insert to close the pocket or (ii) adhesively bonding the pocket flap to an upper portion of the back panel, forming a combined article package.

18. The method of claim 17, further comprising filling a carton with a plurality of combined article packages.

* * * * *